US006266075B1

(12) United States Patent
Feitel et al.

(10) Patent No.: US 6,266,075 B1
(45) Date of Patent: Jul. 24, 2001

(54) PRINTER WITH MEMORY DEVICE FOR STORING PLATEN PRESSURES

(75) Inventors: Mark A. Feitel, Plymouth; David T. Gale, Champlin; Scott C. Milton, Maplewood, all of MN (US)

(73) Assignee: Brady Worldwide, Inc., Milwaukee, WI (US)

( * ) Notice: Subject to any disclaimer, the term of this patent is extended or adjusted under 35 U.S.C. 154(b) by 0 days.

(21) Appl. No.: 09/349,529

(22) Filed: Jul. 8, 1999

(51) Int. Cl.[7] ..... B41J 2/325

(52) U.S. Cl. ..... 347/198; 400/120.16; 400/120.17; 400/56

(58) Field of Search ..... 400/120.01, 55, 400/56, 57, 120.16, 120.17; 347/198

(56) References Cited

U.S. PATENT DOCUMENTS

| | | | |
|---|---|---|---|
| 4,263,664 | 4/1981 | Owen et al. | 365/185 |
| 4,274,012 | 6/1981 | Simko | 307/238.3 |
| 4,300,212 | 11/1981 | Simko | 365/185 |
| 4,314,265 | 2/1982 | Simko | 357/23 |
| 4,326,134 | 4/1982 | Owen et al. | 307/268 |
| 4,393,481 | 7/1983 | Owen et al. | 365/228 |
| 4,404,475 | 9/1983 | Drori et al. | 307/264 |
| 4,440,248 | 4/1984 | Teraoka | 177/4 |
| 4,450,402 | 5/1984 | Owen, III | 324/73 |
| 4,486,769 | 12/1984 | Simko | 357/41 |
| 4,488,060 | 12/1984 | Simko | 307/263 |
| 4,501,224 | 2/1985 | Shibayama et al. | 118/697 |
| 4,520,461 | 5/1985 | Simko | 365/184 |
| 4,533,846 | 8/1985 | Simko | 307/550 |
| 4,599,706 | 7/1986 | Guterman | 365/185 |
| 4,617,652 | 10/1986 | Simko | 365/203 |
| 4,630,538 | 12/1986 | Cushman | 101/45 |
| 4,655,129 | 4/1987 | Wirth et al. | 101/35 |
| 4,668,932 | 5/1987 | Drori et al. | 338/48 |
| 4,676,675 * | 6/1987 | Suzuki et al. | 400/56 |
| 4,710,040 * | 12/1987 | Grey | 400/55 |
| 4,752,912 | 6/1988 | Guterman | 365/185 |
| 4,829,482 | 5/1989 | Owen | 365/189.09 |
| 4,844,632 * | 7/1989 | Minowa | 400/120 |
| 4,874,967 | 10/1989 | Deane | 307/296.8 |
| 4,879,566 * | 11/1989 | Hanabusa | 347/198 |
| 4,883,976 | 11/1989 | Deane | 307/291.2 |
| 4,917,512 * | 4/1990 | Mimura et al. | 400/56 |
| 4,938,616 * | 7/1990 | Shiozaki et al. | 400/120 |
| 5,206,662 | 4/1993 | Fox et al. | 347/198 |
| 5,266,966 * | 11/1993 | Fushimi et al. | 347/220 |
| 5,318,370 | 6/1994 | Nehowig | 400/613 |
| 5,455,617 * | 10/1995 | Stephensen et al. | 347/214 |
| 5,534,909 * | 7/1996 | Hanabusa et al. | 347/216 |
| 5,555,009 * | 9/1996 | Hevenor et al. | 347/198 |
| 5,612,727 | 3/1997 | Morimoto et al. | 347/198 |
| 5,803,627 * | 9/1998 | Paranjpe | 400/240 |
| 5,986,686 * | 11/1999 | Guckin | 347/218 |

FOREIGN PATENT DOCUMENTS

| | | | |
|---|---|---|---|
| 0811504A1 | 12/1997 | (EP) . | |
| 0979736A1 | 2/2000 | (EP) . | |
| 345079 * | 12/1989 | (JP) | 347/198 |
| 2-209252 * | 8/1990 | (JP) | 347/198 |
| 61-188164 * | 8/1990 | (JP) | 347/198 |
| 7076151 | 3/1995 | (JP) . | |

* cited by examiner

*Primary Examiner*—Daniel J. Colilla
(74) *Attorney, Agent, or Firm*—Quarles & Brady LLP

(57) ABSTRACT

A thermal transfer printer wherein labeling media and thermal transfer ink ribbon advances past a print head and a platen. The platen urges the ribbon and the labeling media in close cooperation with the print head. The print head exerts a pressure on the platen to provide a platen pressure when the print head thermally transfers ink from the ink ribbon to the labeling media. The print head is pivotally mounted, such that pivoting the print head applies a continuously variable pressure against the platen.

16 Claims, 13 Drawing Sheets

PRINTER WITH MEMORY DEVICE FOR STORING PLATEN PRESSURES

TECHNICAL FIELD

The present invention relates to a thermal transfer printer, and more particularly to a thermal transfer printer having a variable platen pressure.

DESCRIPTION OF THE BACKGROUND ART

There are a number of U.S. patents that disclose electronic apparatus for printing indicia on labels, some of which are described in U.S. Pat. No. 4,440,248, Teraoka; U.S. Pat. No. 4,501,224, Shibayama; U.S. Pat. No. 4,630,538, Cushing; and U.S. Pat. No. 4,655,129, Wirth et al.

The electronic machines for printing labels of the type disclosed above all include the same general combination of elements, a print head, means for feeding labeling media to be printed past the print head, a microprocessor, a read only memory programmed with appropriate instructions to operate the microprocessor, a random access memory, a keyboard with letter, number, and function keys for the entry of alphanumeric information concerning the indicia to be printed, and a visual display such as a LED/LCD unit to assist the operator in using the machine.

The labeling media comprises a roll of pressure sensitive tape (continuous media or die cut labels)that is attached to a continuous roll of release liner. The labeling media is fed through the printer and legends are printed on the tape. Labels are formed using the continuous tape by cutting the media after the legends are printed thereon. The labels are then removed from the release liner and attached to the objects needing identification. As there are many types of label applications, there are many combinations of tape and release liners that provide labels of varying sizes, colors, formats, and environmental resistance.

A particular type of print head employs thermal transfer printing technology. Thermal transfer printing uses a heat generating print head to transfer a colored coating containing wax, carbon black, or the like, from a thermal transfer ribbon to a labeling media. By using digital technology, characters are formed by energizing a sequence of pixels on the print head which in turn melt the coating on the ribbon transferring the image to the labeling media.

In a known thermal transfer printer such as a label printer, labeling media is fed by a platen roller simultaneously with a ribbon feed roller feeding an ink transfer ribbon. While the labeling media driven by the platen roller runs between the print head and the rotating platen roller, the transfer ribbon is passed between the print head and the platen roller by rotating the ribbon feed roller. As a result, the labeling media and the transfer ribbon pass together in overlay relationship between the print head and the platen roller.

Many of prior art thermal printers disclosed above have ink ribbons containing more than one color for printing multi-colored indicia on the label. These colors are composed of various substances which are optimally printed at different specific platen pressure (i.e., pressure exerted on the platen by the print head). Prior art printers have a single fixed platen pressure, or multiple fixed pressures requiring intervention by the user to change. Even with the multiple fixed pressure printer variety, the desired pressure may lie between the discrete available settings, resulting in printing the color at a less than optimal pressure.

SUMMARY OF THE INVENTION

The present invention is a thermal printer in which the platen pressure is continuously variable over a wide range of values, and which is automatically controlled to provide optimal pressure for the particular ink ribbon being used. The printer includes: a chassis which supports a platen; drive systems for feeding a labeling media and ink ribbon over the platen; a print head pivotally mounted to the chassis for urging the ink ribbon and labeling media against the platen to develop a desired pressure on the platen, and for printing on the labeling media; and a print head subassembly for controlling the pressure on the platen by pivotally moving the print head.

An object of the present invention is to provide a continuously variable platen pressure. This is accomplished by providing a print head subassembly having a pivotally mounted print head which exerts a continuously variable pressure against the platen.

Another object of the present invention is to provide an accurate pressure exerted on the platen by the print head. This is accomplished by controlling the pivotally mounted print head with a closed loop control system having a feedback signal for determining the print head position. The closed loop control system includes a motor to pivot the print head, and a potentiometer to provide a feedback signal indicating the print head position.

Still another object of the present invention is to automatically control the pressure exerted on the platen by the print head. This is accomplished by storing optimal ink pressures on a memory chip located on the ribbon spool. Printer circuitry reads the optimal pressure from the memory chip and causes the print head to exert the desired pressure on the platen.

These and still other objects and advantages of the present invention will be apparent from the description which follows. In the detailed description below, preferred embodiments of the invention will be described in reference to the accompanying drawings. These embodiments do not represent the full scope of the invention. Rather the invention may be employed in other embodiments. Reference should therefore be made to the claims herein for interpreting the breadth of the invention.

DETAILED DESCRIPTION OF THE PREFERRED EMBODIMENTS

Figure 1:
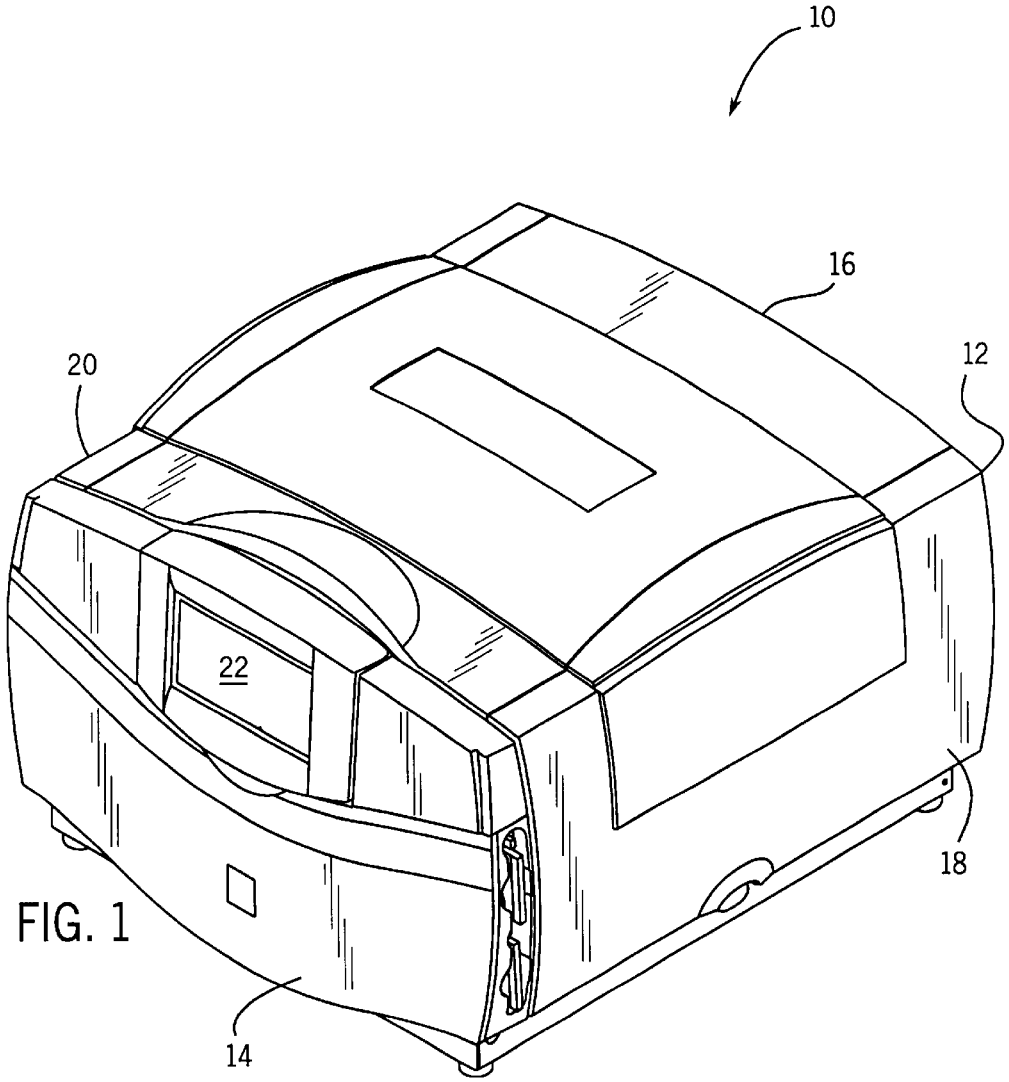
FIG. 1 is a front, right side perspective view of a thermal transfer printer which employs the present invention.

As shown in FIGS. 1–8, a thermal transfer printing machine 10 which employs the preferred embodiment of the present invention includes a molded plastic housing 12 having a front 14, opposing sides 18, 20, and a metal back 16. The housing 12 encloses printer subassemblies 28, 30, 32, 34, and 36 mounted on a chassis 38 (shown in FIGS. 3–5), and supports a LCD display 22 pivotally mounted to the housing front 14. Labels 43 printed on labeling media 40 are ejected from the printer 10 down an exit chute 24, and through an opening 26 formed in the housing side 20. The LCD display 22 displays printer status and error indicators to a user. Printer circuitry 44 mounted to the chassis 38 controls the printer subassemblies 28, 30, 32, 34, and 36 and powers the LCD display 22.

Referring to FIGS., 2–5, the printer chassis 38 is supported by a substantially rectangular base 46 which provides the foundation for the printer 10. The base 46 has a top 48, bottom 50, and sides 52. Four feet 54 mounted in each corner of the base bottom 50 support the base 46. The housing 12 is attached to the base 46 with screws (not shown) threadably engaging clips 55 extending from the base sides 52.

The chassis 38 supports the subassemblies 28, 30, 32, 34, and 36, and has a bottom frame 53 mounted to the printer base top 48, and a top frame 56 pivotally mounted to the bottom frame 53. Looking particularly at FIG. 4, the chassis bottom frame member 53 includes a pair of opposing frame side members 58 mounted to the base top 48 using screws or the like, and supports a labeling media subassembly 28, a cutter subassembly 34, and a label eject subassembly 36. Looking particularly at FIGS. 5 and 6, the chassis top frame 56 has an end frame member 60 joining a pair of opposing frame side members 62 which support a print head subassembly 30 and a thermal transfer ink ribbon subassembly 32.

Figure 7:
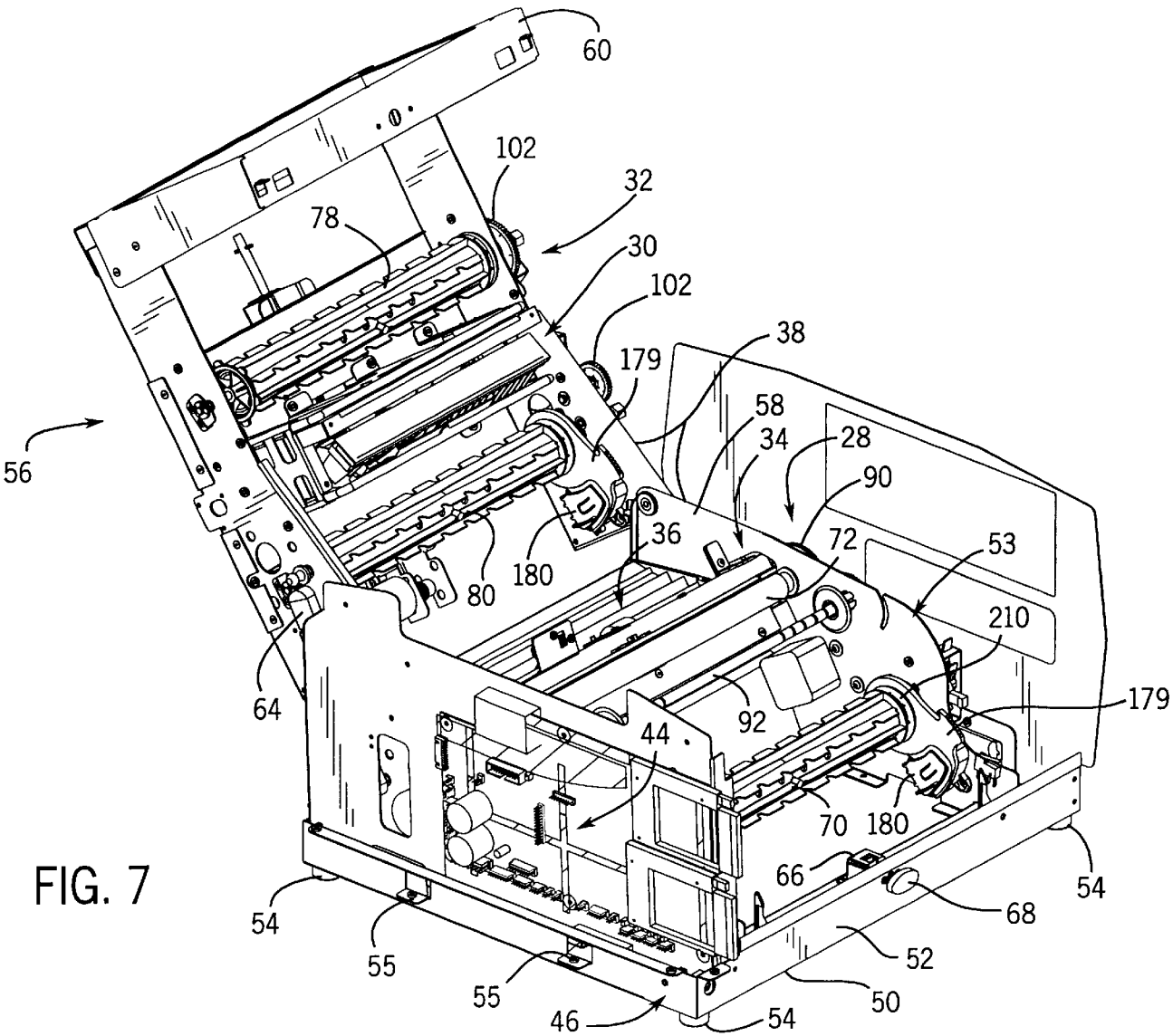
FIG. 7 is a front, right perspective view of the printer in an open configuration.

As shown in FIG. 7, pivotally mounting the top frame 56 allows the user to open the chassis 38 in a clam-shell fashion exposing the subassemblies 28, 30, 32, 34, and 36 for easy maintenance. A pneumatic piston 64 mounted to the top and bottom frames 56,53 restricts the chassis 38 from opening too quickly and damaging the subassemblies 28, 30, 32, 34, and 36 from jarring. Looking at FIG. 7, a latch 66 mounted to the base side 52 catches the chassis top frame member 60 to hold the chassis 38 in the closed position during printer operation, and is released by a button 68 mounted to the base side 52.

Referring back to FIGS. 3 and 4, the labeling media drive subassembly 28 feeds labeling media 40 from the rotatably mounted labeling media supply spool 70 past the print head assembly 30. Preferably, the labeling media 40 is comprised of a release liner 41 which supports an adhesive backed material, such as labels 43 or a continuous sheet of vinyl or polyester. The size, color, and type of label material carried by the spool 70 varies depending upon the particular print application.

The labeling media 40 unrolls off the spool 70 as it is driven by the labeling media drive subassembly 28. The labeling media drive subassembly 28 includes a master cone 84 (shown in FIG. 8) rotatably mounted to one of the chassis bottom frame side members 58, and a slave cone 86 rotatably mounted to the opposing chassis bottom frame side member 58. The cones 84,86 support the labeling media supply spool 70 therebetween. A stepping motor 88, mounted to the same frame member 58 as the master drive cone 84, rotatably drives the master drive cone 84 to dispense labeling media 40 from the supply spool 70. A stepping motor gear mechanism 90 driven by the stepping motor 88 drives an idler roller 92 and the platen 72 to feed the labeling media 40 past the print head assembly 30.

Referring to FIGS. 5–8, the thermal transfer ink ribbon drive subassembly 32 mounted to the chassis top frame 56, and feeds the thermal transfer ink ribbon 76 past the print head subassembly 30 from an ink ribbon supply spool 78 to an ink ribbon take up spool 80. The ink ribbon drive subassembly 32 includes an ink ribbon supply spool master drive cone 94 and opposing slave cone 96, an ink ribbon take up spool master drive cone 98 and opposing slave cone 100, and a gear mechanism 102 for rotatably driving the master drive cones 94,98.

As in the labeling media drive subassembly 28, each ink ribbon spool 78,80 is supported at its ends by the master drive cone 94,98 and the opposing slave cone 96,100. The master drive cones 94,98 are rotatably driven by the gear mechanism 102 mounted on one side of the top frame side member 62 to rotatably drive the take up spool 80 and pull the ink ribbon 76 past the print head 74. The gear mechanism 102 is mounted on the same top frame side member 62 as the master drive cones 94,98 and engages the labeling media drive gear mechanism 90 to provide synchronous movement of the labeling media 40 and ink ribbon 76 past the print head 74.

Figure 8:
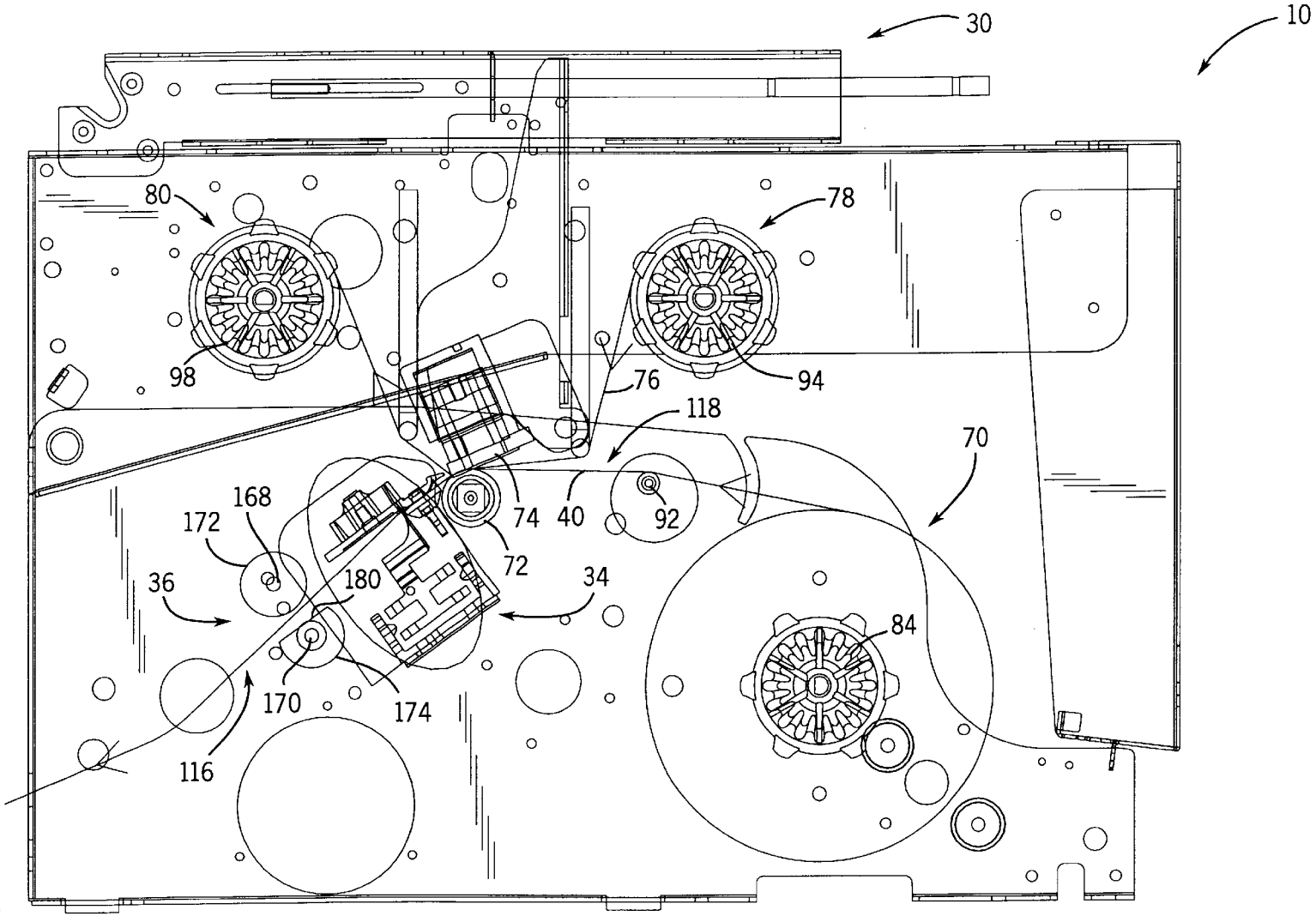
FIG. 8 is a sectional elevation view of FIG. 3 showing the media and ribbon paths.

As shown in FIG. 8, the print head subassembly 30 in the printer 10 is arranged to cooperate with the thermal transfer ribbon 76 and the labeling media 40 such that the thermal print head 74 can print characters or symbols on the labeling media 40. Thermal transfer printing is described in greater detail in U.S. Pat. No. 5,078,523 which is incorporated herein by reference.

Looking particularly at FIGS. 5–8, the print head subassembly 30 is suspended over the platen 72 from a cross bracket 104 having a top 106, bottom 108, and opposing ends 110,112. The cross bracket 104 is supported on each end 110, 112 by the top frame side members 62, and has a downwardly depending print head bracket 114 (shown in FIGS. 9 and 10) mounted to the cross bracket bottom 108.

Figure 9:
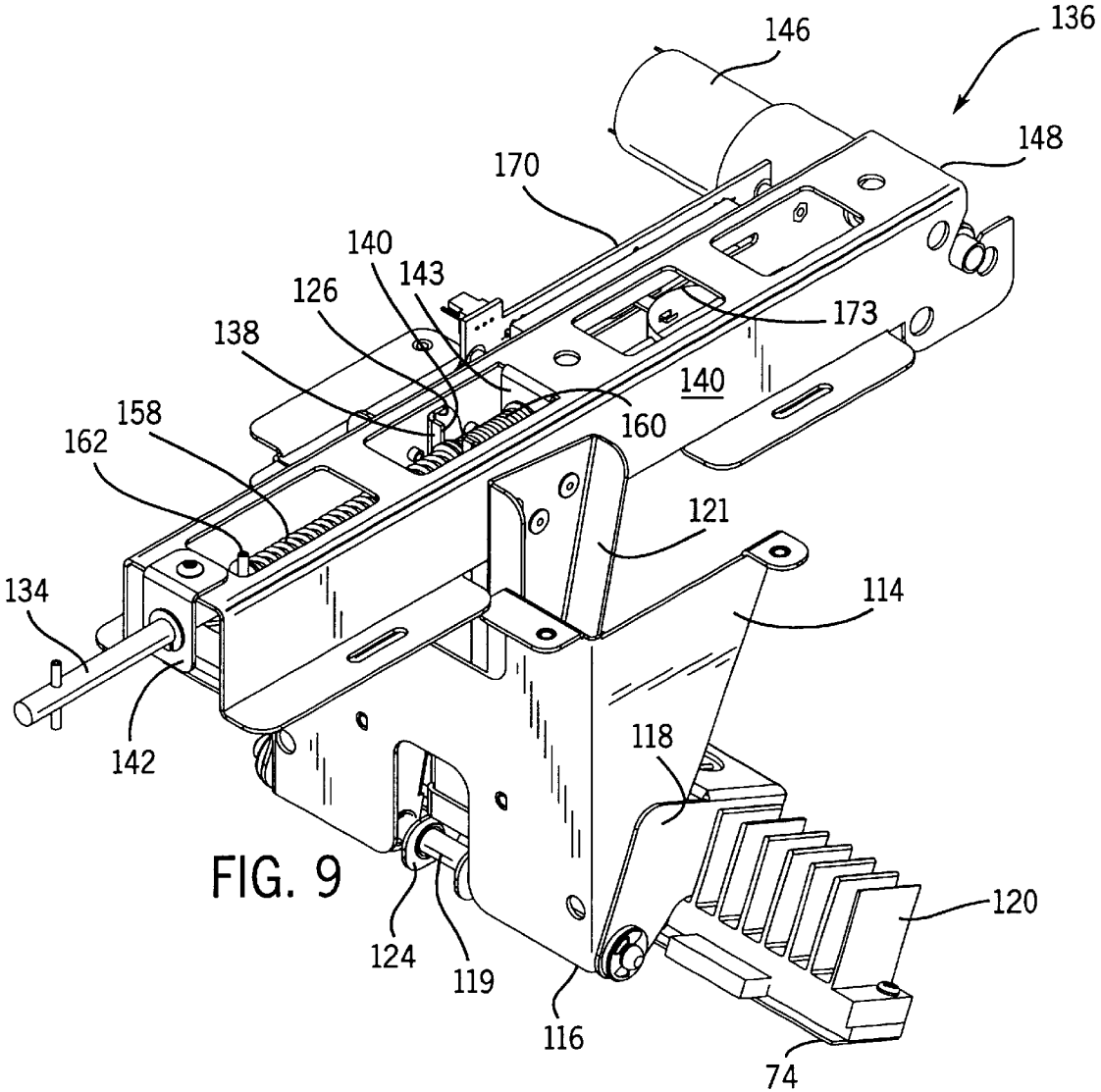
FIG. 9 is a perspective view of the print head subassembly of FIG. 3.
Figure 10:
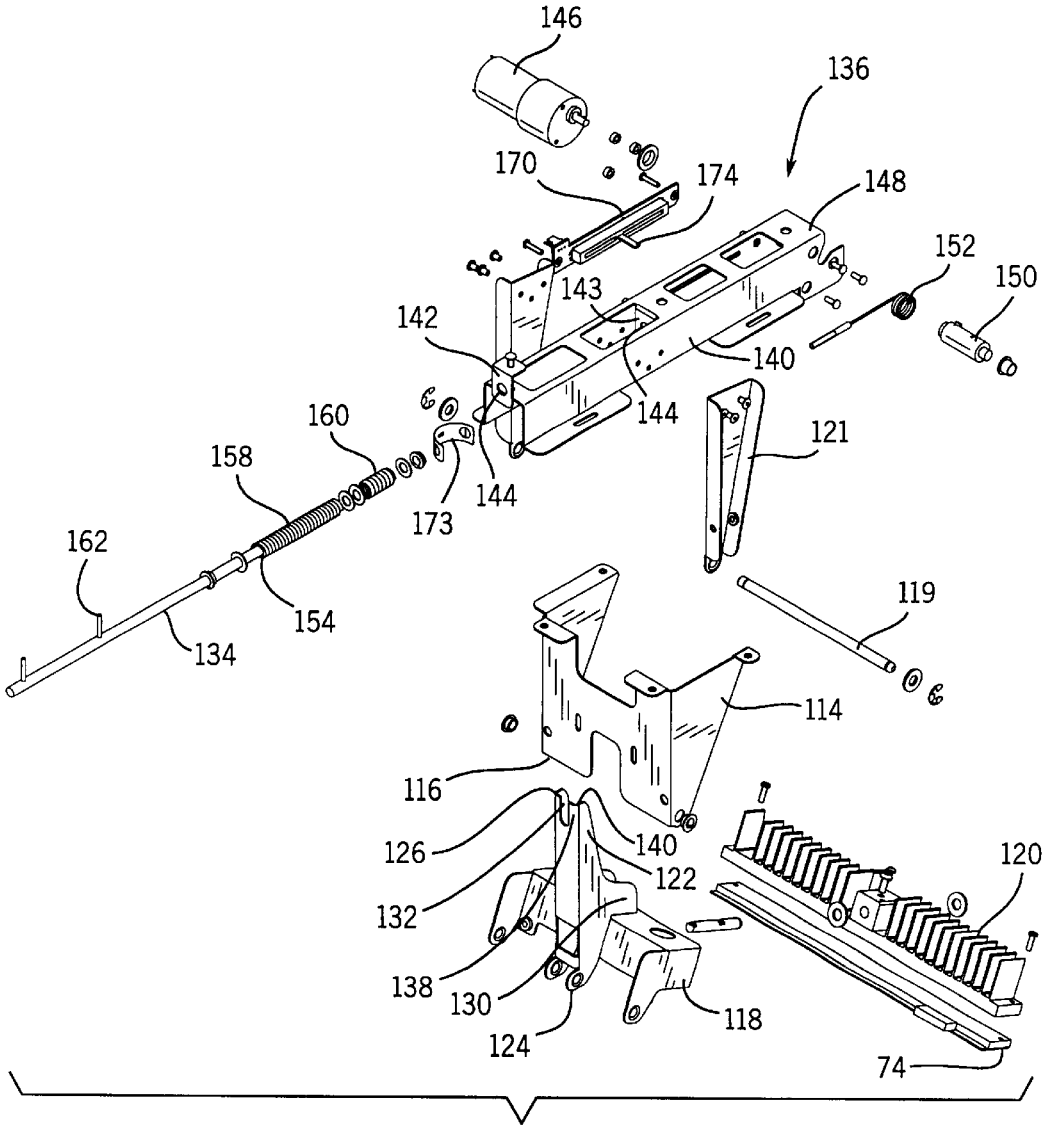
FIG. 10 is an exploded perspective view of the print head subassembly of FIG. 9.

Referring now to FIGS. 8–10, a print head attachment bracket 118 is pivotally mounted to an axle mounted at the print head bracket distal end 116. The print head 74 with a heat sink 120 is mounted to the print head attachment bracket 118 in close proximity to the platen 72. Support brackets 121 mounted to an actuator mechanism 136 further supports the axle, and thus the print head 74.

A pivot lever 122 pivots the print head attachment bracket 118 to move the print head 74 relative to the platen 72, and maintain a desired pressure against the 72 by the print head 74. The pivot lever 122 has a lower end 124 pivotally mounted to the print head bracket distal end 116, and an opposing upper end 126 extending through an aperture 128 (shown in FIG. 5) formed in the cross bracket 104. Arms 130 extending from the pivot lever 122 engage the print head attachment bracket 118 to pivot the print head 74 toward or away from the platen 72. The pivot lever upper end 126 has a slot 132 formed therein which straddles a shaft 134, and opposing faces 138,140 substantially perpendicular to the shaft axis 142.

A variable linear actuator mechanism 136 shifts the shaft 134 in an axial direction to apply a determinable force against the pivot arm upper end face 138. The actuator mechanism 136 includes an actuator housing 140 which is mounted to the cross bracket top 106. Clips 142, 143 formed part of the actuator housing 140 have openings 144 which guide the shaft 134 in an axial direction. A stepping motor 146 mounted to the actuator housing end 148 rotatably drives a reel 150 which wraps and unwraps a cable 152 connected to an end 154 of the shaft 134 to move the shaft 134 in the axial direction and compress springs 158, 160 wrapped around the shaft 134.

The springs 158,160 apply opposing forces to the pivot arm upper end 126 which vary in relation to the axial position of the shaft 134. A force spring 158 presses against one face 138 of the pivot arm upper end 126 and urges the shaft 134 in an axial direction to pivot the print head attachment bracket 118 and urge the print head 74 closer to the platen 72. One end of the force spring 158 abuts a pin 162 rigidly mounted to the shaft 134, and the other spring end abuts the pivot arm upper end 138 face to urge the pivot arm upper end 126 in the axial direction. Axial movement of the shaft 134 which compresses the force spring 158, increases the pressure on the pivot arm upper end 126, and thus the pressure of the print head 74 on the platen 72.

A return spring 160 is coiled around the shaft 134, and applies a force opposing the force spring 158 to reduce the pressure of the print head 74 against the platen 72. One end of the return spring 160 abuts the clip 143, and the spring other end abuts the pivot arm upper end opposing face 140 to urge the pivot arm upper end 126 in the axial direction against the force spring 158. Axial movement of the shaft 134 which compresses the return spring 160 reduces the pressure of the print head 74 on the platen 72. When the stepping motor 146 unwraps the cable 152 from the reel 150, the return spring 160 compresses the force spring 158 to reduce the pressure on the platen 72.

The force applied by the springs 158,160 on the pivot arm upper end 126 is directly related to the axial position of the shaft 134, and thus the pressure applied by the print head 74 against the platen 72. Accordingly, by determining the position of the shaft 134, the pressure on the platen 72 is determined.

A linear potentiometer 170 mounted to the actuator housing 140 determines the axial position of the shaft 134 to determine the pressure applied to the platen 72 by print head 74. The potentiometer 170, such as a Panasonic EWA-Q12C15B14, available from Digi-Key in Thief River Falls, Minnesota, has a slidably moveable lever 174 rigidly connected to the shaft 134 with a spring clip 173. The potentiometer 170 outputs an electrical signal to the printer circuitry 44 (shown in FIG. 11) which is proportional to the position of the lever 174, and thus the platen pressure. The electrical signal from the potentiometer 170 provides feedback to the printer circuitry 44 to close the control loop pivoting the print head 74, and provide an accurate platen pressure.

Figure 11:
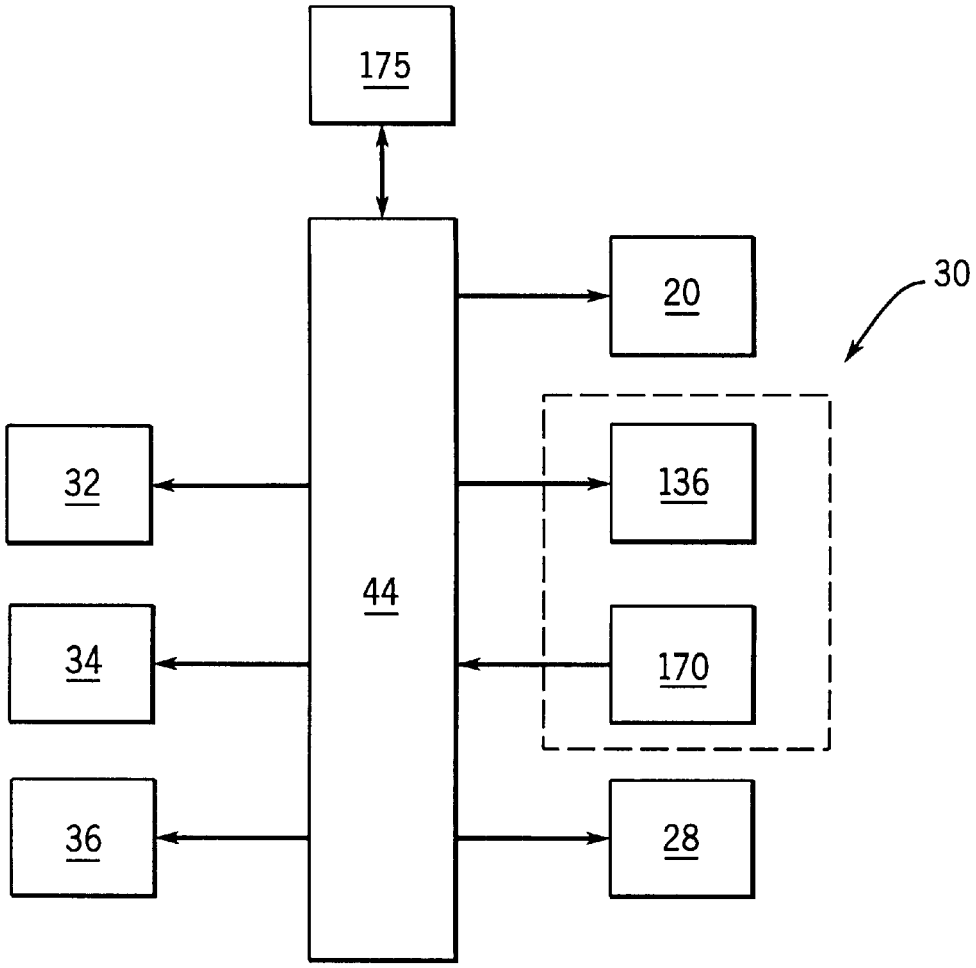
FIG. 11 is a block diagram of printer circuitry of the printer of FIG. 1.

As shown in FIG. 11, the printer circuitry 44 controls the printer subassemblies 28, 30, 32, 34, and 36, and is electrically connected to the memory device 175. The circuitry 44 calculates the desired pressure for the ink ribbon/labeling media combination based upon the desired pressures for the ink ribbon and labeling media. Once the actual desired pressure is calculated, the circuitry actuates the actuator mechanism 136 to move the actuator mechanism shaft 134 (shown in FIG. 9) to the axial position corresponding to the calculated desired pressure. The axial position of the shaft 134 is determined using the linear potentiometer 170 which provides the circuitry 44 with an electrical signal proportional to the axial position of the actuator mechanism shaft 134. The relationship between the shaft position and the platen pressure is stored in the printer circuitry 44 in any form known in the art, such as a table, mathematical expression and the like. to FIGS. 7,8, and 11, the desired platen pressure for each ink color on the ink ribbon 76 is stored in a memory device 175 slidably attached to the ink ribbon take-up spool 80. Preferably, the desired platen pressure for the labeling media 40 is stored on a second memory device 175 slidably attached to the labeling media supply spool 70. The printer circuitry 44 reads the desired platen pressures from the memory devices 175, and determines the desired platen pressure for the particular combination of ink ribbon 76 and labeling media 40.

Figure 13:
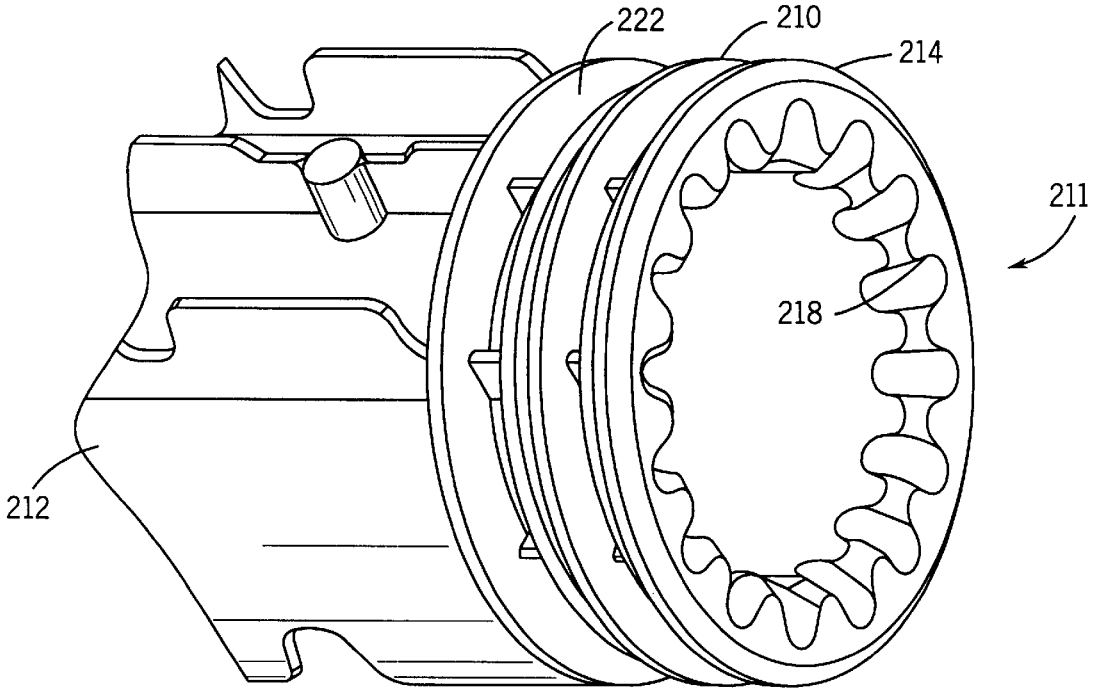
FIG. 13 is a perspective view of an end of the ink ribbon supply spool of FIG. 7.

As shown in FIGS. 7 and 13, the spools 70, 80 include an elongated body 212 having spool ends 210. A circumferential groove 222 formed in the spool body 212 proximal one of the spool ends 210 receives a chip holder 179 described in detail below. The spool ends 210 have sockets 211 formed to engage the ink ribbon drive subassembly cones (such as cones 94, 96 shown in FIG. 5), which are fully described in a copending U.S. Patent Application Ser. No. 09/349,825 entitled "PRINTER SPOOL", filed concurrently with the present application, and which is fully incorporated herein by reference.

Figure 15:
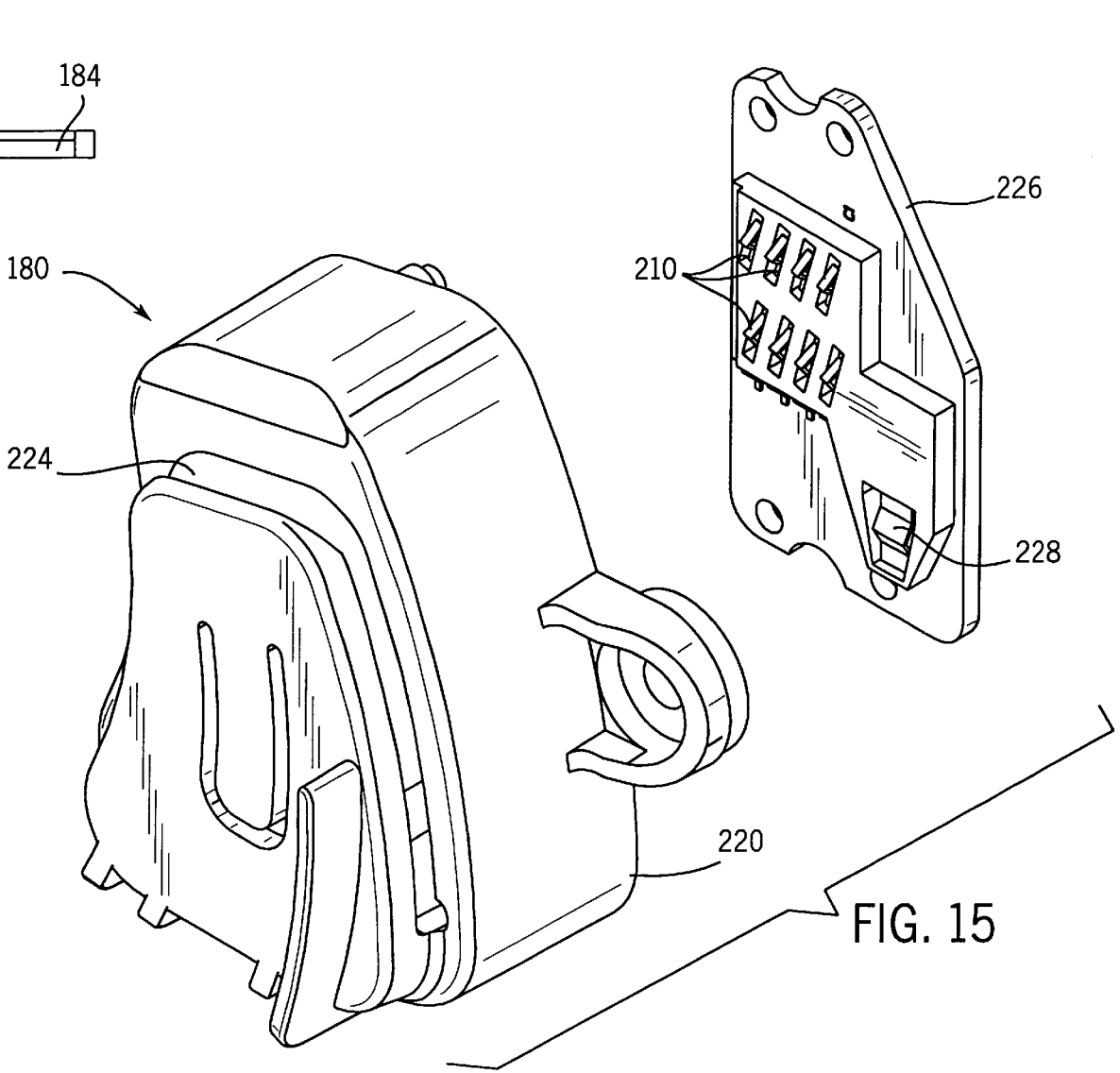
FIG. 15 is an exploded view of an electrical receptacle.
Figure 14:
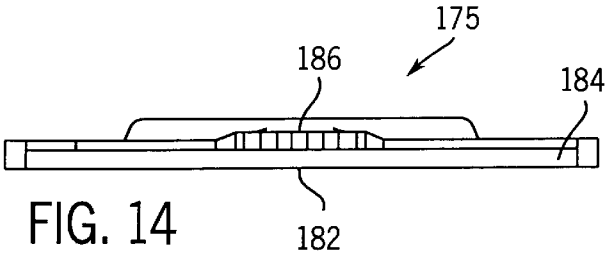
FIG. 14 is a side view of the memory device of FIG. 13.

Referring to FIGS. 7, 14, and 15, the electronic memory device 175 is mounted on the chip holder 179 which is slidably mounted to the spool end 210. The chip holder 179 positions the memory device 175 to electrically connect with a set of stationary contacts 182 which are part of the printer circuitry 44. The stationary contacts 182 are mounted in an electrical 180 which is mounted to the chassis side frame proximal the spool end 210. As the spool 80 rotates during use, the memory device 175 remains fixed to the stationary contacts 182 to communicate with the printer circuitry 44.

Figure 12:
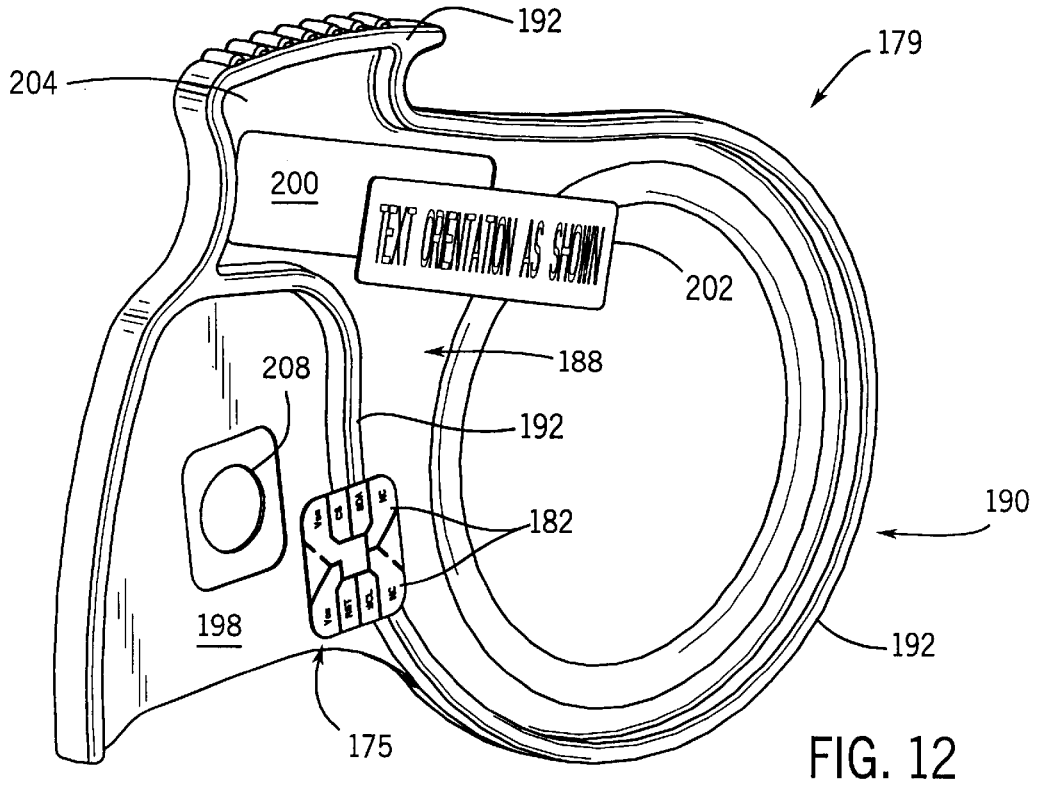
FIG. 12 is a side view of the chip holder of FIG. 7.

The memory device 175 is an electrically alterable read only memory (EAROM),such as the Xicor X76F101 smart chip, available from Xicor, Inc., Sunnyvale, Calif. The contents of the memory device can be changed, but are not lost when power is removed from the device. As shown in FIGS. 12 and 14, the memory device 175 includes a printed circuit board 184 having the memory device in integrated circuit form 186 mounted on one side, and electrical contacts 182 (best shown in FIG. 12) electrically connected to the integrated circuit 186 etched into the other side. The memory device 175 stores desired platen pressures, and other information, such as burn values, other color information, ribbon width, supply remaining, head pressure, CRC, and the like, for use in the printing operation.

As shown in FIGS. 3, 7, 12, and 13, the memory device 175 is mounted to the chip holder 179 which is slidably mounted to the spools 70, 80. Referring to FIGS. 7 and 12, the chip holder 179 encircles the spool end 210, and has a substantially flat portion 188 for affixing a label 202 and mounting the memory device 175 thereon. A loop 190 extends from the flat portion 188, and is received in the groove 222 formed proximal the spool end 210 to slidably attach the chip holder 179 to the spool end 210.

A rib 192 formed on the loop periphery strengthens the loop 190, and extends through the flat portion 188 to divide it into a chip mounting section 198 and a label section 200. Advantageously, the rib 192 also serves as a stop to abut the electrical receptacle 180 and properly locate the chip electrical contacts 182 in the receptacle 180.

The chip holder flat portion label section 200 receives a label 202 for providing machine readable information, such as a barcode, and user readable information, such as printed text. A finger lip 204 extends from the label section 200 to aid the user when inserting or extracting the chip holder 179 from the electrical receptacle 180. The rib 192 extends along an outer edge of the finger lip 204 to provide a surface for the user to press the holder 179 into the receptacle 180, or to grasp and pull the holder 179 out of the receptacle 180.

The chip mounting section 198 has a cavity 208 formed therein for receiving the memory device 175. The memory device 175 is mounted in the cavity 208, using methods known in the art , such as ultrasonic welding, adhesives and the like, so as to present the electrical contacts 182 in a predetermined orientation for engaging the stationary electrical receptacle contacts 182.

Referring to FIGS. 7, 12, and 15, the chip mounting section 198 is slipped into a slot 224 formed in the electrical receptacle 180 to electrically connect the memory device 175 to the printer circuitry 44. As shown in FIG. 15, the electrical receptacle 180 has a housing with the slot 224 for receiving the chip mounting section 198 of the chip holder 179. The stationary receptacle contacts 182 are mounted in the receptacle housing 220 on a removable plate 226 to simplify assembly, and are arranged facing the slot 224 to electrically engage the memory device electrical contacts 182. A limit switch 228 mounted to the plate 226 is electrically connected to the printer circuitry 44 (shown in FIG. 3), and provides a signal to the circuitry 44 when the chip holder 179 is fully inserted in the housing slot 224. Preferably, the electrical receptacle 180 is a memory cell reader, available from Amphenol, Canton, Mich., which has electrical contacts specially adapted for engaging the preferred smart chip electrical contacts.

Figure 2:
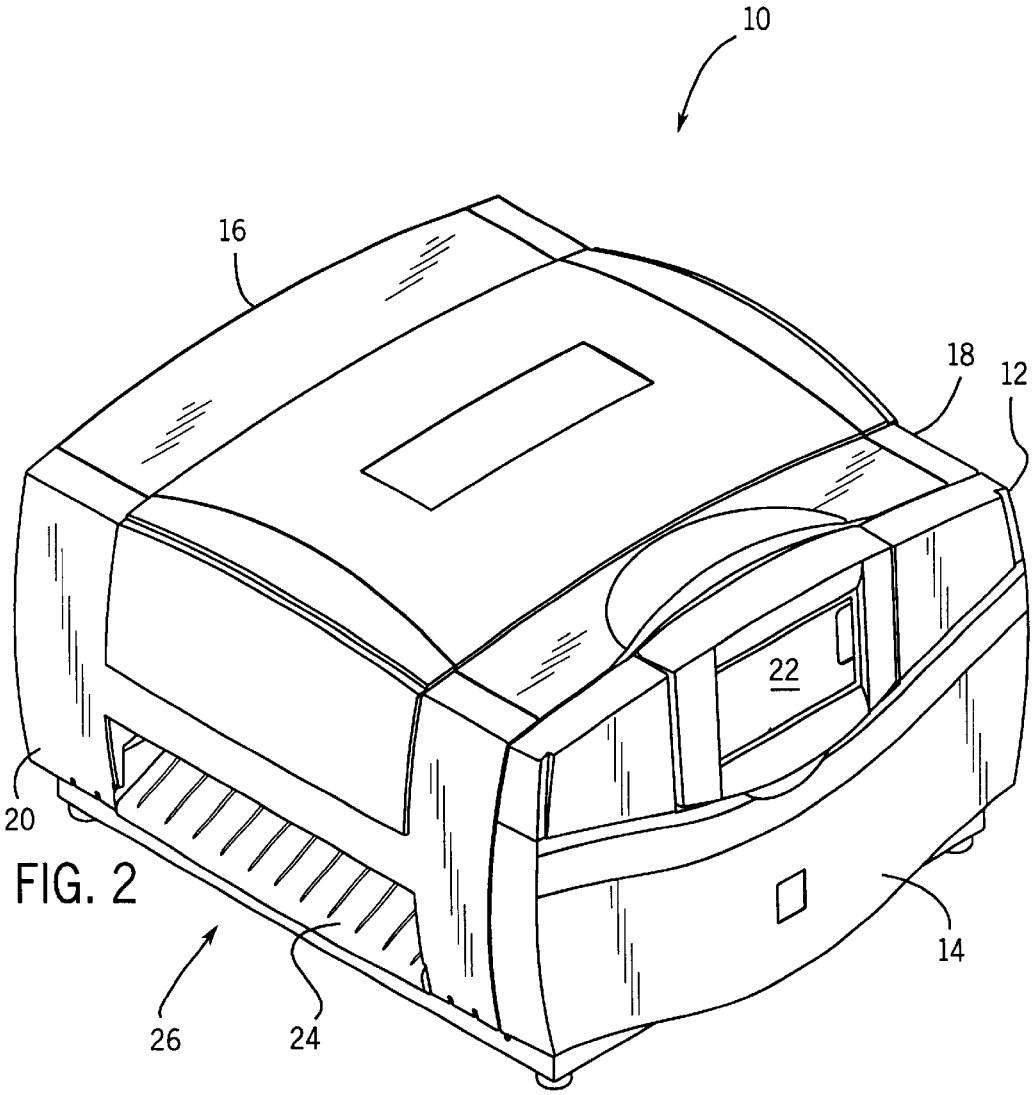
FIG. 2 is a front, left side perspective view of the printer in FIG. 1.
Figure 3:
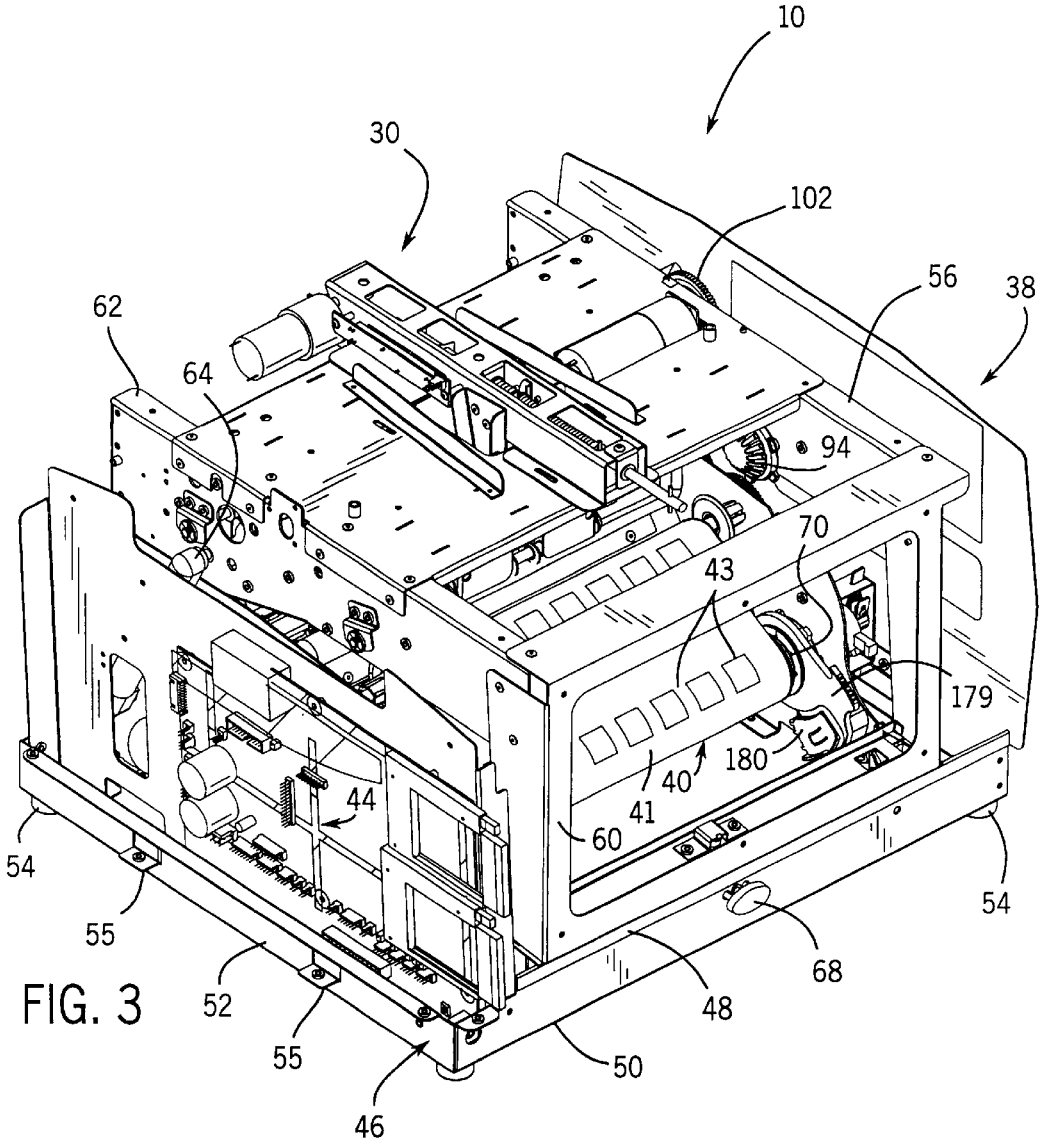
FIG. 3 is a front, right side perspective view of the printer of FIG. 1 with the housing removed.
Figure 4:
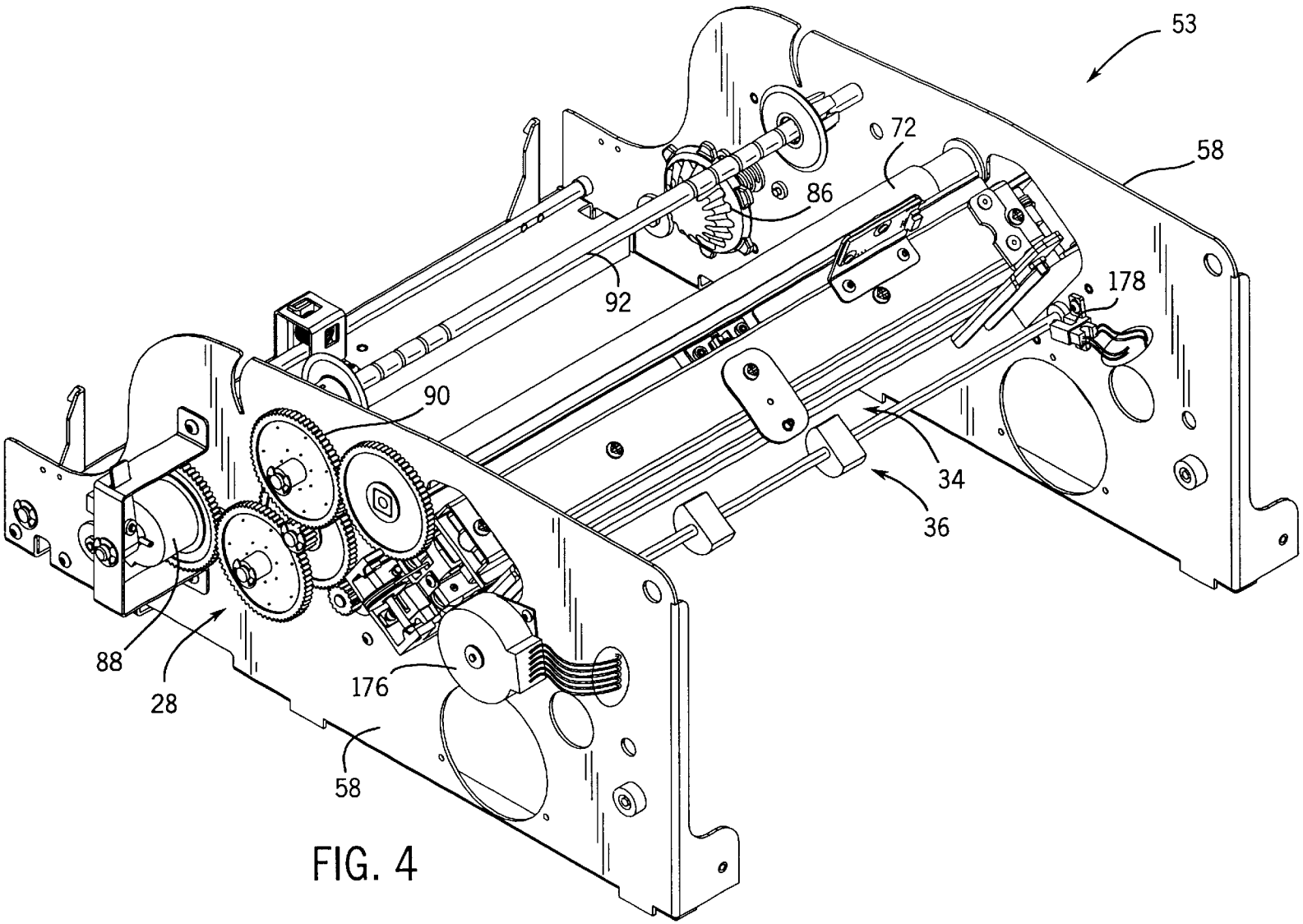
FIG. 4 is a rear, left side perspective view of the printer chassis lower frame of FIG. 3.
Figure 5:
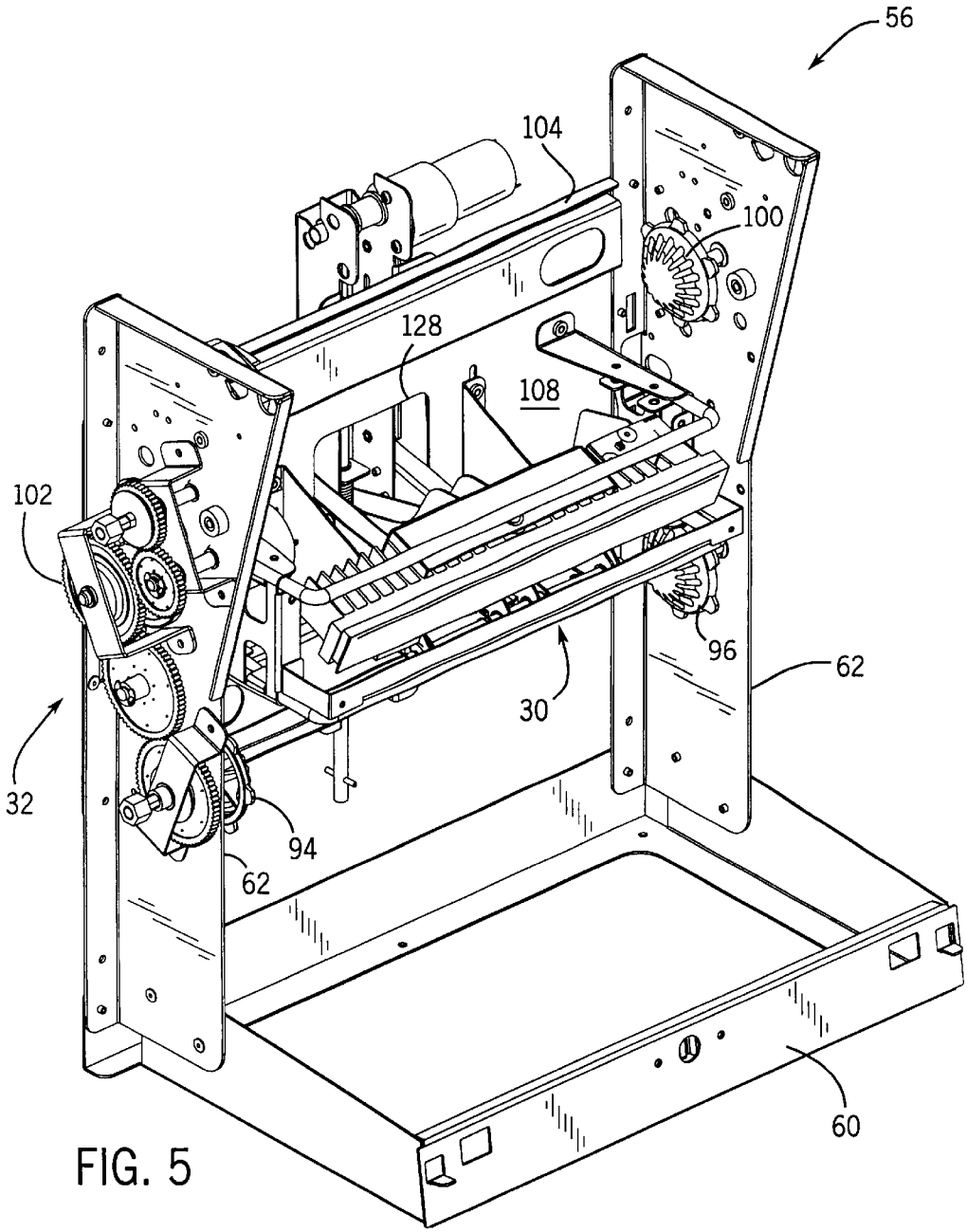
FIG. 5 is a bottom, left side perspective view of the printer chassis top frame of FIG. 3.
Figure 6:
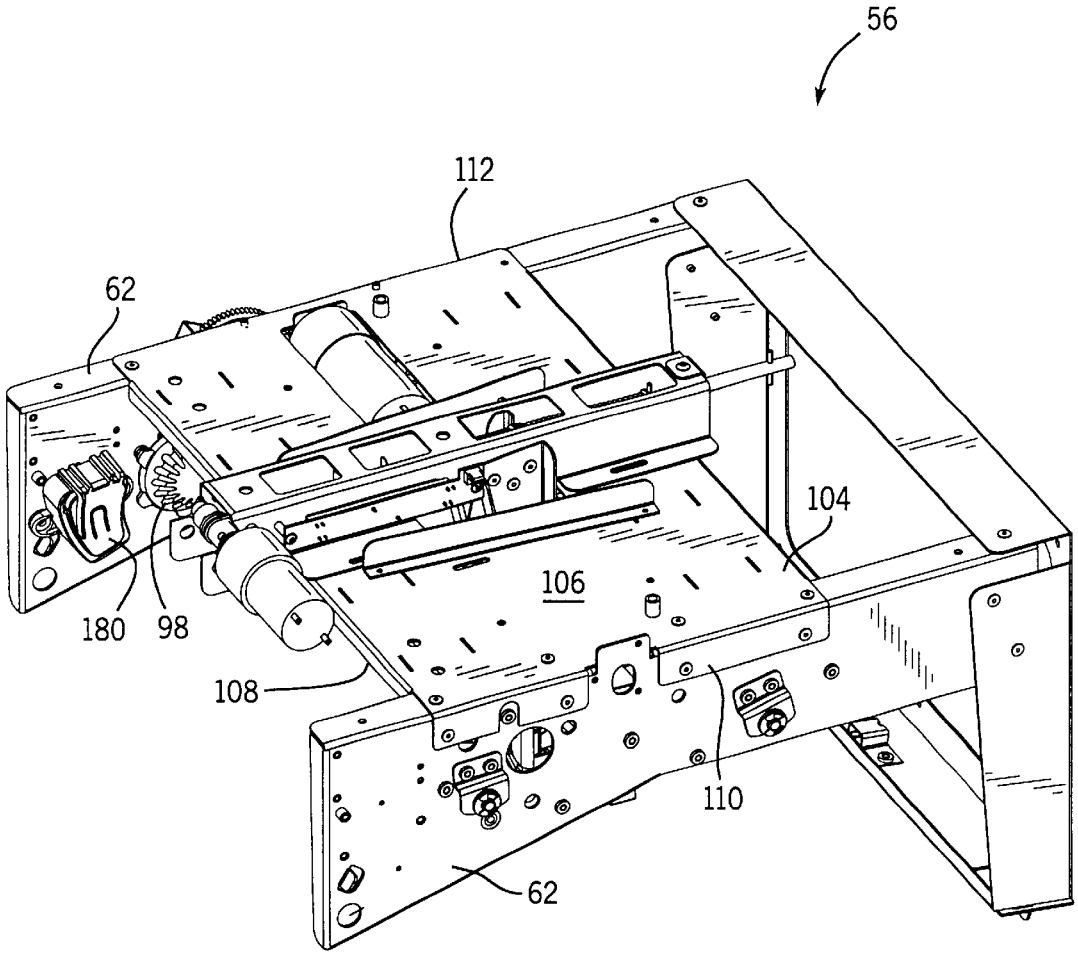
FIG. 6 is a top, right side perspective view of the printer chassis top frame of FIG. 3.

As shown in FIGS. 7 and 8, once the print head subassembly 30 prints a label on the labeling media 40, the labeling media drive subassembly 28 advances the labeling media 40 past the cutter subassembly 34. The cutter subassembly 34 cuts the printed labeling media 40 which is ejected by the label eject subassembly 36 down the exit chute 24, and out of the housing opening 26 (chute 24 and exit housing 26 are shown in FIG. 2). The cutter subassembly 34 and label eject subassembly 36 are fully described in a co-pending U.S. patent application Ser. No. 09/349,530 entitled "PRINTER WITH CUTTER EJECT SYSTEM," filed concurrently with the present application, and which is fully incorporated herein by reference.

Referring to FIGS. 1–15, in use, the labeling media drive subassembly 28 and thermal transfer ribbon drive subassembly 32 feed the labeling media 40 and ink ribbon 76 past the platen 72 and pivotally mounted print head 74. The platen 72 urges the labeling media 40 and ink ribbon 76 in close proximity with the print head 74, and the print head 74 exerts a pressure against the platen 72.

The pressure exerted by the print head 74 is varied by pivoting the print head 74 toward or away from the platen 72. The print head 74 is pivoted by moving the actuator mechanism shaft 134 linked to the pivot lever 122. The actuator mechanism shaft 134 is axially moved by the actuator mechanism 136 which is energized by the printer circuitry 44 to provide the desired pressure on the platen 72. The linear potentiometer 170 determines the position of the shaft 134 to provide a feedback signal to the circuitry 44 which is proportional to the degree of pivoting of the print head 74, and thus the pressure on the platen 72.

The desired pressure on the platen 72 during printing is determined by the printer circuitry 44 which reads the desired pressure for the ink ribbon 76 from the memory devices 175 mounted to the ink ribbon supply spool 80 and labeling media supply spool 70. To provide the desired pressure on the platen 72, the circuitry 44 actuates the actuator mechanism 136 to move the pivot lever 122 and pivot the print head 74 to the position corresponding to the desired pressure. When the ink ribbon 76 is reversed, the print head 74 is pivoted away from the platen 72 to clear the platen 72.

While there has been shown and described what are at present considered the preferred embodiment of the invention, it will be obvious to those skilled in the art that various changes and modifications can be made therein without departing from the scope of the invention defined by the appended claims.

We claim:

1. A thermal transfer printer comprising:

a platen;

a pivotally mounted print head in close proximity with said platen for transferring ink from an ink ribbon onto labeling media interposed between said print head and said platen wherein pivoting said print head exerts a pressure against said platen by said print head;

an actuator mechanism linked to said print head, wherein actuation of said actuator mechanism pivots said print head and varies said pressure against said platen to provide a desired pressure on said platen;

printer circuitry electrically connected to said actuator mechanism for controlling said actuator mechanism:

a first memory device having stored thereon at least one first platen pressure specific to the ink ribbon, said memory device being electrically connected to said printer circuitry for communicating said first platen pressure to said printer circuitry to determine said desired pressure on said platen based upon said first platen pressure, wherein said circuitry reads said first platen pressure from said first memory device, and actuates said actuator mechanism to pivot said print head to provide said desired pressure on said platen, wherein said first memory device is mounted to an ink ribbon spool feeding ink ribbon past said platen and said print head.

2. The thermal transfer printer as in claim 1, including a second memory device having stored thereon a second platen pressure specific to the labeling media, said second memory device being electrically connected to said printer circuitry for communicating said second platen pressure to said printer circuitry to determine said desired pressure on said platen based upon said first and second platen pressures.

3. The thermal transfer printer as in claim 2, in which said second memory device is mounted to a labeling media supply spool feeding labeling media past said platen and said print head.

4. The thermal transfer printer as in claim 2, in which said memory devices are nonvolatile and electrically alterable memories.

5. A thermal transfer printer comprising:

a platen;

a pivotally mounted print head in close proximity with said platen for transferring ink from an ink ribbon onto labeling media interposed between said print head and said platen, wherein pivoting said print head exerts a pressure against said platen by said print head;

an actuator mechanism linked to said print head, wherein actuation of said actuator mechanism pivots said print head and varies said pressure against said platen to provide a desired pressure on said platen;

printer circuitry electrically connected to said actuator mechanism for controlling said actuator mechanism; and a mechanism for determining the pressure exerted by said print head on said platen, and producing a signal for the printer circuitry, wherein said mechanism is a linear potentiometer for producing a signal for the printer circuitry which is proportional to the pressure exerted by said print head against said platen.

6. A print head subassembly suitable for use in a thermal transfer printer, said subassembly comprising;

a print head bracket having a distal end proximal a platen;

a print head pivotally mounted to said print head bracket, wherein pivoting said print head exerts a pressure against the platen when said print head prints on labeling media by causing ink from an ink ribbon to transfer onto the labeling media, an actuator mechanism linked to said pivot head for pivoting said print head;

a pivot arm linked to said print head for pivoting said print head, said pivot arm having one end fixedly connected to said print head, and a second end extending away from said print head, and in which said actuator mechanism has a linearly actuated shaft, said shaft being linked to said pivot arm second end, wherein actuation of said shaft moves said pivot arm second end to pivot said pivot head and vary the pressure against the platen and circuitry electrically connected to said actuator mechanism for controlling said actuator mechanism.

7. The print head subassembly as in claim 6, including a linear potentiometer for outputting a signal to said circuitry, said signal being proportional to the position of the print head to provide closed loop control of said print head.

8. A thermal transfer printer comprising:

a chassis having side frame members;

a platen interposed between said side frame members;

a print head subassembly mounted to said chassis, said print head subassembly having a print head in close proximity to said platen, wherein said print head exerts a pressure against said platen for transferring ink from an ink ribbon onto labeling media;

printer circuitry electrically connected to said print head subassembly for varying said pressure against said platen;

a first memory device having stored thereon a first platen pressure specific to the ink ribbon, wherein said printer circuitry reads said first platen pressure from said first memory device, and varies said pressure on said platen in response to said first platen pressure; and a second memory device having stored thereon a second platen pressure specific to the labeling media, wherein said printer circuitry reads said second platen pressure from said second memory device, and varies said pressure on said platen in response to said first and second platen pressures.

9. The printer as in claim 8, in which said memory devices are nonvolatile and electrically alterable memories.

10. The printer as in claim 8, including a labeling media supply spool rotatably mounted between said side frame members, and said second memory device being connected to said labeling media supply spool.

11. The printer as in claim 8, in which said print head is pivotally mounted in said print head subassembly for exerting a variable platen pressure.

12. A thermal transfer printer comprising:

a chassis having side frame members;

a platen interposed between said side frame members;

a print head subassembly mounted to said chassis, said print head subassembly having a print head in close proximity to said platen, wherein said print head exerts a pressure against said platen for transferring ink from an ink ribbon onto labeling media;

printer circuitry electrically connected to said print head subassembly for varying said pressure against said platen;

a first memory device having stored thereon a first platen pressure specific to the ink ribbon, wherein said printer circuitry reads said first platen pressure from said first memory device, and varies said pressure on said platen in response to said first platen pressure; and an ink ribbon spool rotatably mounted between said side frame members, and said first memory device being connected to said ink ribbon spool.

13. A thermal transfer printer comprising:

a platen;

a pivotally mounted print head in close proximity with said platen for transferring ink from an ink ribbon onto labeling media interposed between said print head and said platen, wherein pivoting said print head exerts a pressure against said platen by said print head;

an actuator mechanism for pivoting said print head to exert a pressure on said platen, printer circuitry electrically connected to said actuator mechanism for controlling said actuator mechanism; and a first memory device having electrically stored thereon a plurality of first platen pressures specific to ink ribbon colors on the ink ribbon, wherein each first platen pressure of said plurality of first platen pressures corresponds to at least one of said ink ribbon colors, and being electrically connected to said printer circuitry for communicating said first platen pressures to said printer circuitry to determine a desired pressure on said platen for each ink color based upon said corresponding first platen pressure , wherein said circuitry reads said first platen pressures from said first memory device, and actuates said actuator mechanism to pivot said print head to provide said desired platen pressure on said platen for the ink color being transferred onto the labeling media.

14. The thermal transfer printer as in claim 13, said first memory device being mounted to an ink ribbon spool feeding ink ribbon past said platen and said print head.

15. The thermal transfer printer as in claim 13, including a second memory device having a second platen pressure specific to the labeling media electrically stored thereon, said memory device being electrically connected to said printer circuitry for communicating said second platen pressure to said printer circuitry, and said printer circuitry calculates said desired pressure on said platen using said first and second pressures.

16. A thermal transfer printer comprising:

a platen;

a pivotally mounted print head in close proximity with said platen for transferring ink from an ink ribbon onto labeling media interposed between said print head and said platen, wherein pivoting said print head exerts a pressure against said platen by said print head;

an actuator mechanism linked to said print head, wherein actuation of said actuator mechanism pivots said print head and varies said pressure against said platen to provide a desired pressure on said platen;

printer circuitry electrically connected to said actuator mechanism for controlling said actuator mechanism;

a first memory device having stored thereon at least one first platen pressure specific to the ink ribbon, said memory device being electrically connected to said printer circuitry for communicating said first platen pressure to said printer circuitry to determine said desired pressure on said platen based upon said first platen pressure, wherein said circuitry reads said first platen pressure from said first memory device, and actuates said actuator mechanism to pivot said print head to provide said desired pressure on said platen wherein a plurality of first platen pressures specific to the ink ribbon are electrically stored on said first memory device.

* * * * *